US006050311A

United States Patent [19]

Obenski

[11] Patent Number: 6,050,311

[45] Date of Patent: Apr. 18, 2000

[54] CREDIT CARD WALLET

[76] Inventor: Kenneth S. Obenski, 4412 Pescadero Ave., San Diego, Calif. 92107

[21] Appl. No.: 09/135,432

[22] Filed: Aug. 17, 1998

Related U.S. Application Data

[63] Continuation-in-part of application No. 29/059,118, Sep. 3, 1996.

[51] Int. Cl.[7] ..... A45C 1/06

[52] U.S. Cl. ..... 150/139; 150/131; 150/132; 150/140; 150/146; 150/147; 383/38; 383/40; 229/72

[58] Field of Search ..... 229/72, 92.1; 383/38, 383/40; 150/111, 112, 127, 129, 131, 132, 133, 134, 136, 138, 140, 141, 146, 139, 147

[56] References Cited

U.S. PATENT DOCUMENTS

| | | | |
|---|---|---|---|
| 384,527 | 6/1888 | Jocelyn | 150/112 X |
| 1,108,274 | 8/1914 | Taylor | 229/72 X |
| 1,339,392 | 5/1920 | Hire | 229/72 X |
| 1,597,866 | 8/1926 | Peeff | 229/92.1 |
| 2,280,889 | 4/1942 | Buxton | 229/72 X |
| 2,351,341 | 6/1944 | Immordino | 150/139 X |
| 2,437,534 | 3/1948 | Jackler | 150/129 X |
| 3,199,562 | 8/1965 | Seitz | 229/72 X |
| 4,531,667 | 7/1985 | Meade | 229/72 X |
| 5,346,120 | 9/1994 | Da Costa et al. | 229/92.1 X |
| 5,445,199 | 8/1995 | Jia | 229/139 X |
| 5,730,530 | 3/1998 | Stoddard et al. | 229/439 X |

*Primary Examiner*—Stephen P. Garbe
*Assistant Examiner*—Tri M. Mai
*Attorney, Agent, or Firm*—Henri J. A. Charmasson; John D. Buchaca

[57] ABSTRACT

A billfold and credit card carrier engineered for minimum thickness has a pair of nested pockets shaped and dimensioned to hold adjacent stacks of banknotes, and series of credit card-sized pockets for holding credit cards, driver's license, and other similarly sized documents in side-by-side arrangements.

8 Claims, 1 Drawing Sheet

CREDIT CARD WALLET

PRIOR APPLICATION

This is a continuation-in-part application of copending application Ser. No. 29/059,118 filed Sep. 3, 1996.

FIELD OF THE INVENTION

This invention relates to wallets, purses, and portfolios, and more specifically to billfolds intended to carry bank notes and a variety of identification documents and credit cards.

BACKGROUND OF THE INVENTION

The sizes and layouts of wallets and billfolds, especially those used by gentlemen, have hardly changed over the last seventy-five years. Yet, the type and size of documents now currently carried in those articles is vastly different from those carried by our fathers and grandfathers. In the twenties and thirties, wallets and billfolds were designed to hold banknotes and some pieces of identification of various dimensions.

Nowadays, credit cards have almost supplanted cash. Most business cards, driving licenses and other such documents have adopted the same format as the standard credit card. The old style of wallet provides a very inefficient arrangement for these credit card-sized documents that leads to a very bulky package which tends to form unsightly and uncomfortable bulges in the jacket or pants pockets of their owners.

SUMMARY OF THE INVENTION

The principal and secondary objects of this invention are to provide a wallet or billfold specifically organized to accommodate a number of banknotes and a large number of credit cards and credit card-sized documents in the most efficient, compact and thinnest possible arrangement.

These and other valuable objects are achieved by a wallet having a series of pockets shaped, dimensioned and positioned to hold side-by-side stacks of credit card-sized documents. Bills are also held in a pair of nesting pockets in which the shallowest occupies about half the space inside the largest one.

DESCRIPTION OF THE PREFERRED EMBODIMENT OF THE INVENTION

Figure 1:
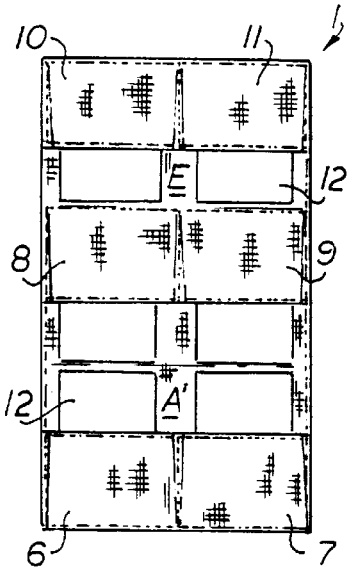
FIG. 1 is a top plan view of an open billfold according to the invention.
Figure 4:
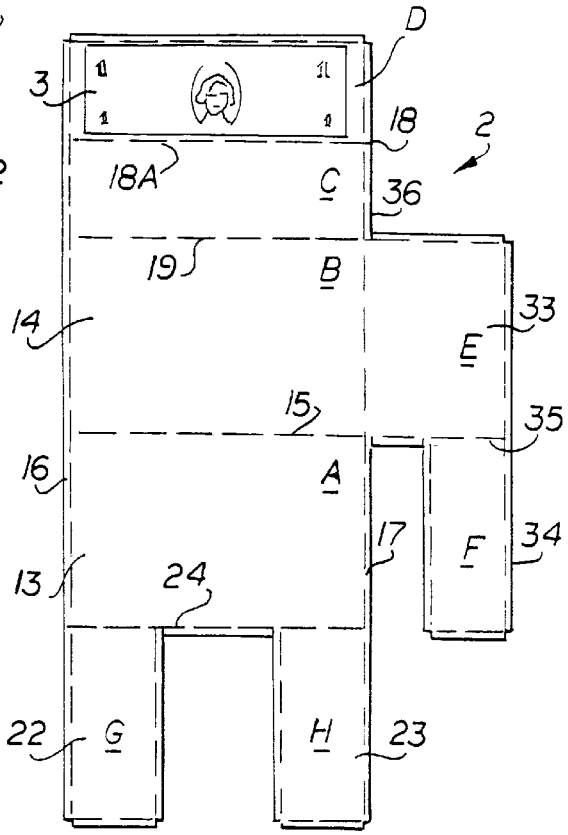
FIG. 4 is a top plan view of a cut sheet of material used in the fabrication of the billfold.

Referring now to the drawing, there is shown a billfold 1 according to the invention. The billfold is made from a single sheet 2 of so-called spinnaker ripstop fabric, or other thin material of comparable strength, cut in the pattern shown in FIG. 4 folded along the various broken lines. The pattern is selected to minimize the amount of unused waste material. The folding lines divide the sheet into eight panels whose upper faces are marked with references A–H. The back faces of those panels as they appear in other figures are correspondingly labeled A'–H'. Panel faces C and D are preferably slightly larger than a U.S. bank note 3 as illustrated in FIG. 4.

When assembled, the billfold features two bank note pockets 4 and 5 and three pairs of side-by-side smaller pockets 6–11 which are shaped and dimensioned to accommodate business cards, credit cards, driver's license, and similarly sized documents 12. It should also be noted that a hidden compartment 5A the size of a bank note is also formed between pockets 4 and 5.

Figure 3:
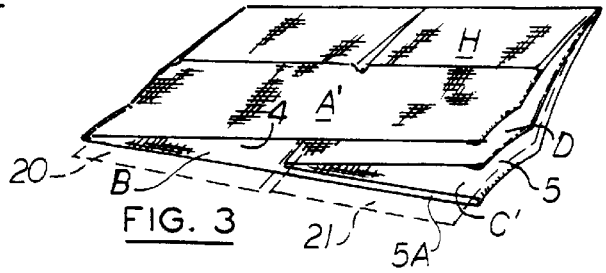
FIG. 3 is a cross-sectional view taken along line 3—3 of FIG. 2.
Figure 2:
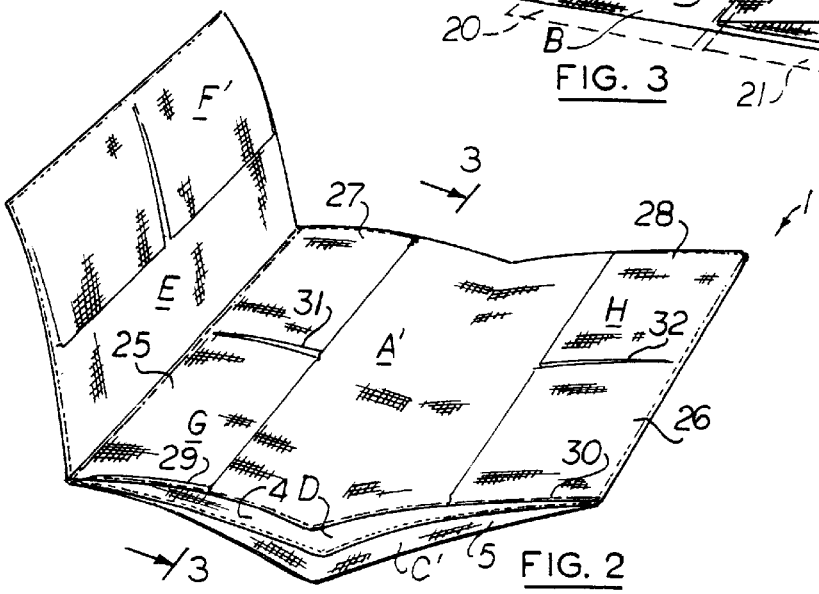
FIG. 2 is a perspective view thereof in a partially open position.

The billfold comprises a inner panel or sheet 13 and a commensurate cover sheet 14 which when folded against each other along fold line 15 and joined along lateral edges 16 and 17, to form the first pocket 4. Before assembling this first pocket, panel half-faces C' and D' of panel 18 are folded toward each other along their separating line 18A and over the cover panel 14 along fold line 19 to form the second bank note pocket 5. Accordingly, panel 18 has the same shape and dimensions as the inner and cover panel. It should be noted that the second pocket 5 is about half the size of the larger bank note pocket 4 and is nested within it. Accordingly, two bank notes or stacks of bank notes 20, 21 can be held in a side-by-side arrangement within the respective pockets as illustrated in dotted line in FIG. 3.

The widths of the inner and cover sheets 13, 14 may be slightly reduced below the combined width of two U.S. bank notes in order that the billfold fit within the limited space of blue jeans and other pants back pockets while keeping the width of the inner pocket panel 18 slightly larger than said combined widths. In such case, stacks of bank notes respectively stacked in pockets 4 and 5 will slightly overlap each other with mimimum increase in overall thickness of the billfold.

Two pocket panels 22, 23 are laid over inner sheet 13 by folding them about fold line 24. They are then secured to the inner sheet along their cut longitudinal edges 25 and 26 respectively and along their ending edges 27 and 28. The opposite ending edges corespond to the fold line 24. The pocket panels 22, 23 are also secured to the inner sheet along their median transversal lines 31, 32 to form two pairs of side-by-side credit card-sized pockets 7 and 8, 9. The other pair of back-credit card-sized pockets 10, 11 is similarly formed by folding pocket panel 34 over the flap panel 33 along folding line 35, and joining those panels in the same manner as for each half of the inner sheet 13.

For strength and better look, a narrow marginal strip 36 along the sides or edges of each panel or sheet is folded into each seam or joint.

The inner and cover panels 13, 14 are preferably approximately 18.5 by 13 centimeters (7.5 by 5.25 inches).

While the preferred embodiment of the invention has been described, modifications can be made and other embodiments may be devised without departing from the spirit of the invention and the scope of the appended claims.

What is claimed is:

1. A billfold having at least two unsealed pockets shaped and dimensioned to hold bank notes, said billfold comprising:

a quadrangular inner sheet having first, second, third and fourth contiguous sides;

a cover sheet commensurate with, and joined to said inner sheet along said first, second and third sides to form a first pocket having an open side; and a third sheet substantially commensurate with said inner and cover sheets, said third sheet being folded alone a median line and secured along opposite sides astride said median line to opposite, joined sides of said inner and cover sheets to form a second pocket having an open side within said first pocket;

wherein said folded third sheet has an unsecured edge congruent and in line with said fourth side of the inner sheet, whereby said second pocket occupies substantially a first half of said first pocket.

2. The billfold of claim 1, wherein said second pocket is shaped and dimensioned to hold at least one unfolded U.S. bank note.

3. The billfold of claim 1, which further comprises at least one web having two longitudinal edges and two ending edges perpendicular to one of said longitudinal edges, said web being joined along said longitudinal edge perpendicular to said end edges, along said end edges, and along a median transversal line to a first exposed portion of said inner sheet to form at least two side-by-side document-holding areas.

4. The billfold of claim 3, wherein each of said document-holding areas is shaped and dimensioned to engage substantially half of as least one credit card-sized document;

whereby another half of said document remains visible.

5. The billfold of claim 4, which further comprises:

a quadrangular flap having a side commensurate with, and secured to, said first side of the inner sheet; and a third web secured along three of its sides to said flap to form at least one pocket.

6. The billfold of claim 3, which further comprises a second web secured to a second exposed portion of said inner sheet symmetrically with said first web.

7. The billfold of claim 1, wherein said sheet is made of ripstop fabric.

8. The billfold of claim 7, wherein said fabric is a spinnaker-type fabric.

* * * * *